US006602056B1

(12) United States Patent
Totten

(10) Patent No.: US 6,602,056 B1
(45) Date of Patent: Aug. 5, 2003

(54) STEAM DRIVEN PUMP

(75) Inventor: Timothy K. Totten, Marcellus, MI (US)

(73) Assignee: Armstrong International, Inc., Three Rivers, MI (US)

( * ) Notice: Subject to any disclaimer, the term of this patent is extended or adjusted under 35 U.S.C. 154(b) by 133 days.

(21) Appl. No.: 09/896,394

(22) Filed: Jun. 29, 2001

(51) Int. Cl.[7] ..... F04F 1/06
(52) U.S. Cl. ..... 417/133
(58) Field of Search ..... 417/133, 130, 417/131, 132, 134

(56) References Cited

U.S. PATENT DOCUMENTS

| | | | | |
|---|---|---|---|---|
| 5,065,785 A | | 11/1991 | Deacon et al. | |
| 5,141,405 A | * | 8/1992 | Francart, Jr. | 417/133 |
| 5,611,672 A | * | 3/1997 | Modesitt | 417/131 |
| 5,755,560 A | | 5/1998 | Yumoto | |
| 5,947,145 A | | 9/1999 | Schlesch et al. | |
| 6,015,267 A | * | 1/2000 | Yumoto | 417/54 |
| 6,099,260 A | | 8/2000 | Reynolds | |
| 6,244,829 B1 | * | 6/2001 | Yumoto | 417/133 |

OTHER PUBLICATIONS

PITBULL Stainless Steel Sump Ejector, Bulletin AFH–211, 5/01, two pages.

Competitive Comparison, PITBALL Sump Ejector, May 2001, 4 pages.

Questions and Answers, PITBULL Sump Ejector, May 2001, pp. 1–4.

Sales Call Outline Summary, PITBULL Sump Ejector, May 2001, pp. 1 and 2.

Zatkoff Seals & Packings, American Variseal Selection Guide, pp. 360–362, 367 and 373.

* cited by examiner

*Primary Examiner*—Teresa Walberg
*Assistant Examiner*—Vinod D Patel
(74) *Attorney, Agent, or Firm*—MacMillan, Sobanski & Todd, LLC

(57) ABSTRACT

A pump has a housing including at least one fluid channel; a motive fluid inlet port; a suction fluid inlet port; and a discharge port. The pump also includes a venturi disposed in the fluid channel of the housing. The venturi is connected by way of the fluid channel to the motive fluid inlet port, the suction fluid inlet port, and the discharge port. A ball check valve is operatively disposed between the motive fluid inlet port and the venturi for controlling the flow of motive fluid. The pump further includes an actuator assembly for actuating the ball check valve. In the preferred embodiment, the ball check valve has only an opened position and a closed position.

19 Claims, 7 Drawing Sheets

STEAM DRIVEN PUMP

BACKGROUND OF INVENTION

This invention relates in general to a pump, and more particularly to a steam driven pump for draining fluid from a container.

Steam driven pumps and ejectors are useful in draining unwanted fluid from containers such as steam pits, tunnels, enclosed spaces, and the like. A typical conventional steam driven pump or ejector includes a tapered venturi channel or siphon and a float-operated piloted steam valve. As fluid in a container accumulates, a ball float raises upward until the upward motion of the float opens the pilot valve, which in turn fluidly actuates a second valve, and admits motive steam into the pump or ejector. The jet action of the motive steam creates a vacuum in the ejector, and entrains the fluid from the container, discharging both fluids under pressure through a discharge port. The ejector may include an on/off valve in which the valve is open within a first range of predetermined float levels and closed within a second range of predetermined float levels. Such pumps or ejectors are typically made of a combination of steel, stainless steel, copper, brass, and the like. The piloted steam valve is typically made of steel. Actuating mechanisms and piloted valves made of steel require frequent inspection to check for rust and other contaminants carried by the motive steam, which can cause fouling of the float lever assembly and the piloted valve.

Another typical conventional steam driven pump or ejector includes a tapered venturi channel or siphon, and a modulating float-operated valve, rather than an on/off piloted steam valve. Movement of the float along a shaft actuates the steam valve, and admits motive steam into the pump or ejector. The jet action of the motive steam creates a vacuum in the ejector, and entrains the fluid from the container, discharging both fluids under pressure through a discharge port. Such pumps or ejectors are also made from a combination of steel, stainless steel, copper, brass, and the like. In such a modulating valve design, it is possible for the motive steam to bleed past the valve and the valve seat, causing premature wear of the seat and failure of the pump.

It would therefore be advantageous to provide a pump that is reliable, resistant to corrosion, and has a long service life. It would also be advantageous to provide a pump that is compact in size, has a simple design, and is easy to maintain. It would further be advantageous to provide a pump that prevents bleeding of steam past the valve.

SUMMARY OF INVENTION

The above objects as well as other objects not specifically enumerated are achieved by a pump comprising: a housing having at least one fluid channel; a motive fluid inlet port; a suction fluid inlet port; and a discharge port. The pump also includes a venturi disposed in the fluid channel of the housing. The venturi is connected by way of the fluid channel to the motive fluid inlet port, the suction fluid inlet port, and the discharge port. A ball check valve is operatively disposed between the motive fluid inlet port and the venturi for controlling the flow of motive fluid. The pump further includes an actuator assembly for actuating the ball check valve. In the preferred embodiment, the ball check valve has only an opened position and a closed position.

In another embodiment of the invention, the pump includes a housing having at least one fluid channel; a motive fluid inlet port; a suction fluid inlet port; and a discharge port. The pump also includes a venturi disposed in the fluid channel of the housing. The venturi is connected by way of the fluid channel to the motive fluid inlet port, the suction fluid inlet port, and the discharge port. A valve having only an opened position and a closed position is operatively disposed between the motive fluid inlet port and the venturi for controlling the flow of motive fluid. The pump further includes an actuator assembly directly connected to the valve by a mechanical linkage for actuating the valve, and a suction fluid detector for detecting a level of suction fluid.

In an additional embodiment of the invention, the pump includes a housing having at least one fluid channel; a motive fluid inlet port; a suction fluid inlet port; and a discharge port. The pump also includes a venturi disposed in the fluid channel of the housing. The venturi is connected by way of the fluid channel to the motive fluid inlet port, the suction fluid inlet port, and the discharge port. A valve having only an opened position and a closed position is operatively disposed between the motive fluid inlet port and the venturi for controlling the flow of motive fluid. The pump further includes an actuator assembly directly connected to the valve by a mechanical linkage for actuating the valve, a suction fluid detector for detecting a level of suction fluid, and a container for containing suction fluid.

Various objects and advantages of this invention will become apparent to those skilled in the art from the following detailed description of the preferred embodiment, when read in light of the accompanying drawings.

DETAILED DESCRIPTION OF THE INVENTION

Figure 1:
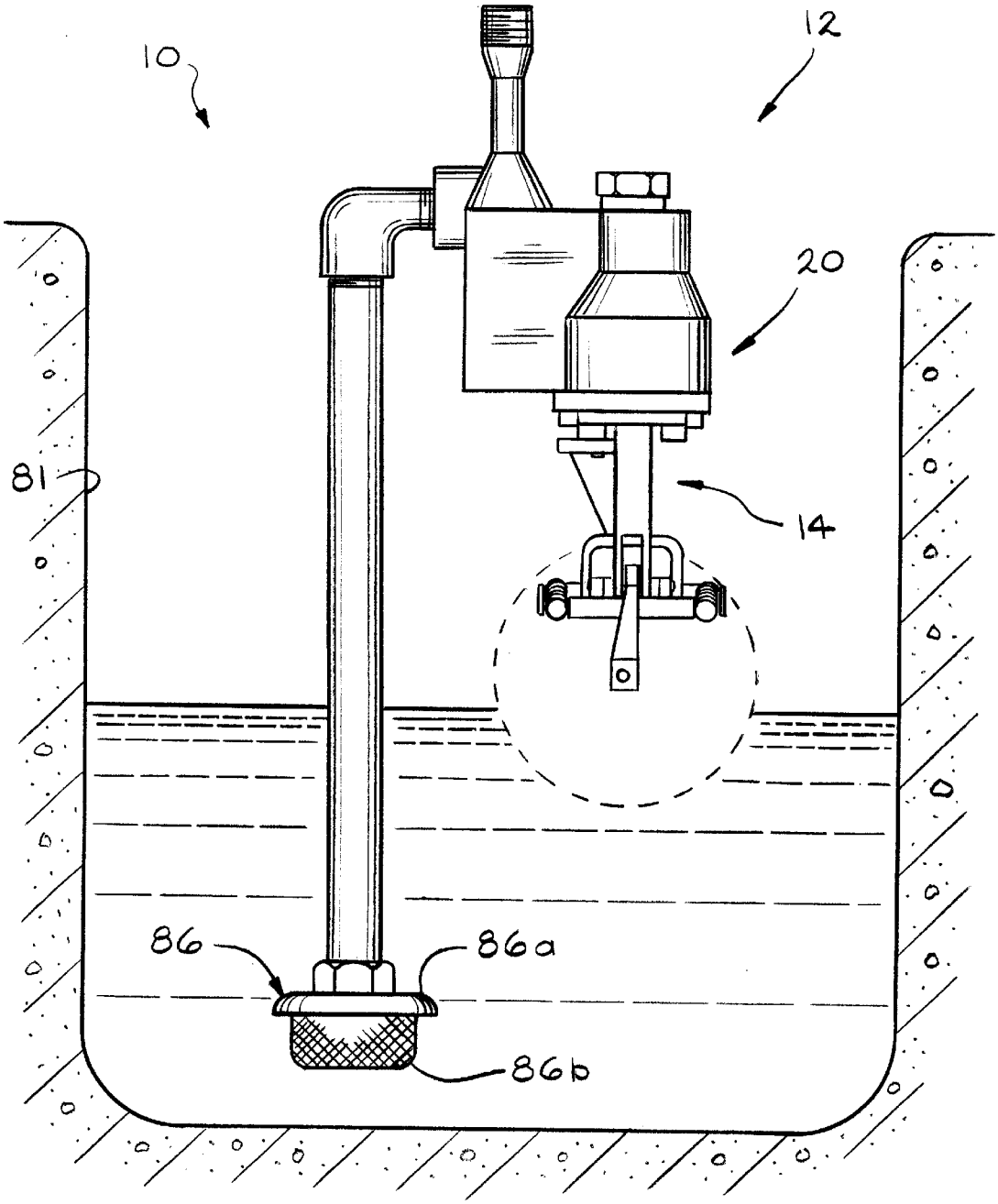
FIG. 1 is a front elevational view of the stream driven pump of the invention.

Referring now to the drawings, there is illustrated in FIGS. 1 through 4 a pump assembly, shown generally at 10. The pump assembly 10 includes a pump, shown generally at 12, and an actuator assembly, shown generally at 14.

The pump 12 includes a generally cylindrical housing 20. The housing 20 includes an axial passage 28 having a first end defining an inlet channel 22 for receiving a motive fluid valve assembly 24. The motive fluid valve assembly 24 includes an externally threaded valve body 26. The valve body 26 includes a flange portion **26*a*, a threaded portion 26*b*, and a shaft 26*c*. The flange portion 26*a* is preferably hexagonally shaped for receiving a tool. The inlet channel 22 is threaded for receiving the valve body 26. The axial passage 28 of the housing 20 further includes a second end for receiving a mounting flange 42. An axial passage 25 is formed in the valve body 26 and includes a generally annular valve seat 30 for supporting a generally spherical valve 32. The valve 32 cooperates with the seat 30 to close and open the motive fluid valve assembly 24. The valve assembly 24 is commonly known as a ball check valve. An annular groove 31 is formed in the surface of the axial passage 25 intermediate the valve seat 30 and the flange portion 26***a* for receiving a retaining clip 33. Retaining clip 33 prevents the valve 32 from traveling outward of the valve assembly 24 through the axial passage 25.

A plurality of radial channels 34 provide fluid communication between the axial passage 25 and a generally annular channel 36 formed in a surface of the annular passage 28 intermediate the first and seconds ends of the annular passage 28. A washer 38 is sealingly disposed between the threaded portion 26*b* of the valve body 26 and a lip 40 formed in the axial passage 28.

The mounting flange 42 is disposed between the housing 20 and the actuator assembly 14. The mounting flange includes a generally planar flange 44, a shaft portion 46, and an axial bore 48 for receiving a push rod 164 of the actuator assembly 14. The shaft portion 46 has a diameter slightly smaller than the diameter of the axial passage 28 and is sealingly disposed in the axial passage 28 opposite the valve assembly 24. The outer surface of the shaft portion 46 includes a plurality of annular grooves 49 for receiving O-rings 50. The O-rings 50 prevent leaking around the shaft portion 46. The inner surface of the axial bore 48 includes an annular groove 52 for receiving a generally U-shaped spring biased rod seal 54, and an annular groove 56 for receiving an inverted, generally U-shaped rod wiper 58. The rod seal 54 prevents leaking around the push rod 164. The rod wiper 58 prevents contaminants from entering the housing 20 between the push rod 164 and the bore 48.

Figure 5:
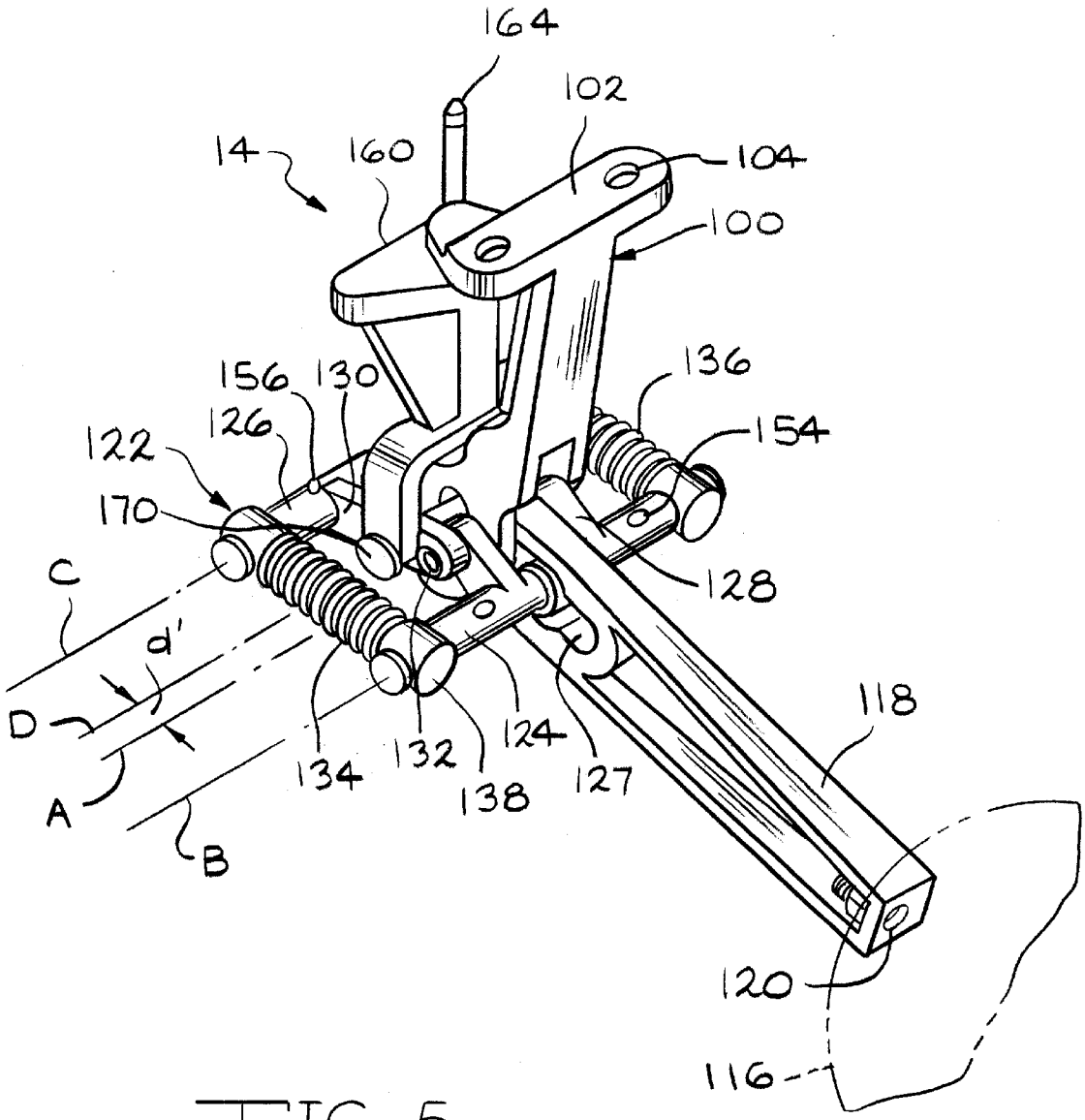
FIG. 5 is a perspective view of actuator assembly illustrated in FIG. 1 showing the float in a down position.
Figure 7:
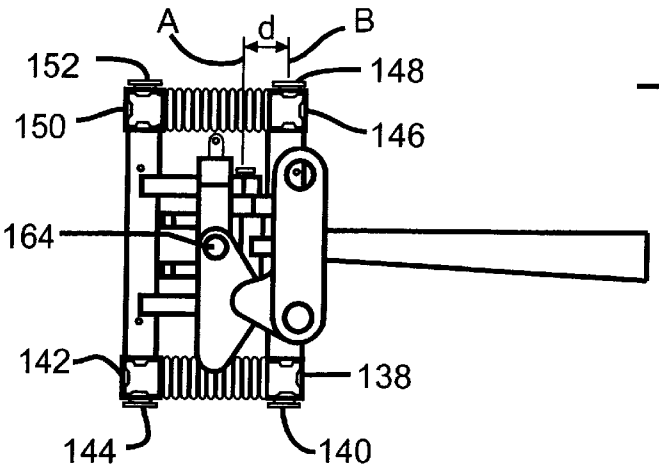
FIG. 7 is a top view of the actuator assembly of FIG. 5.
Figure 8:
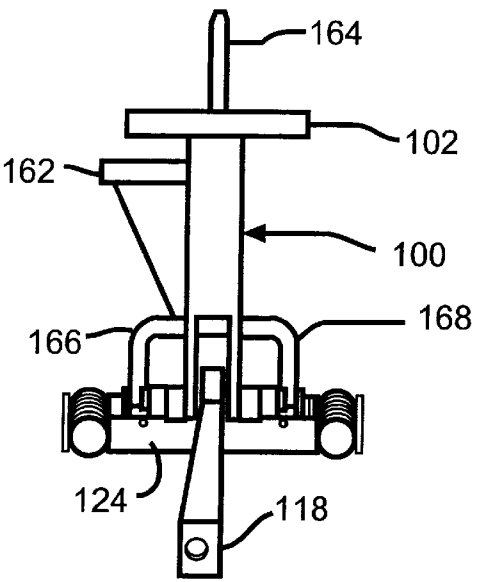
FIG. 8 is a front elevational view of the actuator assembly of FIG. 5.

Preferably, the actuator assembly 14 and the mounting flange 42 are secured to the housing 20 by a plurality of threaded fasteners 60. The threaded fasteners 60 extend through apertures 104 in the actuator assembly 14 as shown in FIG. 5, openings in the flange 44 and into cooperation with threaded bores (not shown) formed in the housing 20. Preferably the O-rings 50 are formed of ethylene propylene rubber (EPDM), the rod seal 54 is formed of polytetrafluoroethylene (PTFE), and the rod wiper 58 is formed of nitrile.

The housing 20 further includes a channel 62 for receiving an externally threaded generally cylindrical ejector nozzle 64. The ejector nozzle 64 includes a threaded head 64*a*, a shaft 64*b* having a diameter slightly smaller than the diameter of the channel 62, and an end portion 64*c* having a diameter smaller than the diameter of the shaft 64*b*. The nozzle 64 also includes a flow channel 66, commonly known as a venturi, having a converging channel 66*a* and a diverging channel 66*b*. The venturi 66 serves to increase the flow velocity of fluid as it moves through the nozzle 64. The channel 62 includes a threaded portion 62*a* for receiving the threaded head 64*a* of the nozzle 64, and a chamber portion 62*b* defined as the area between the outer surface of the end portion 64*c* of the nozzle 64 and the inner surface of the channel 62. A generally cylindrical chamber 67 is formed with the nozzle 64 adjacent the converging channel 66*a*. A plurality of radial channels 68 formed in the nozzle 64, provide fluid communication between the chamber 67, and an annular channel 70 formed within the housing 20. An internal fluid channel 76 is transversely disposed between the axial passage 28 and the channel 62, and provides fluid communication between the annular channel 36 and the annular channel 70. A washer 72 is sealingly disposed between the ejector nozzle 64 and a lip 74 formed in the channel 62. An aperture 78 is formed in an exposed end of the ejector nozzle 64 for receiving a tool such as a hex wrench. The outer surface of the nozzle 64 includes an annular groove 77 for receiving an O-ring 79. The O-ring 79 prevents leaking around the ejector nozzle 64. As with O-ring 50, the O-ring 79 is preferably formed of EPDM.

Suction fluid, such as condensate, enters the housing 20 through a generally cylindrical suction fluid inlet port 80. The fluid inlet port 80 is fluidly connected to the chamber portion 62*b* of the channel 62. The chamber portion 62*b* and the diverging channel 66*b* of the venturi 66 are fluidly connected to an outlet channel 82 defining a discharge port 83.

As shown in FIG. 1, one end of a suction fluid pipe 84 is connected to the fluid inlet port 80 by any suitable means such as threaded fasteners or welding. The suction fluid pipe 84 provides fluid communication between the fluid inlet port 80 and a container 81 for containing suction fluid. The other end of the suction fluid pipe 84 includes an inlet strainer assembly 86 for preventing contaminants within the suction fluid from entering the suction fluid pipe 84. Typically, the strainer assembly 86 includes a body 86*a* formed from glass and nylon fiber and a strainer portion 86*b* formed of stainless steel. The inlet strainer assembly 86 may be connected to the pipe 84 by any suitable means such as threaded fasteners or welding.

Preferably, the housing 20, fluid valve assembly 24, seat 30, valve 32, flange 42, nozzle 64, and suction fluid pipe 84 are made of stainless steel. However, it will be understood that the housing 20, fluid valve assembly 24, seat 30, valve 32, flange 42, nozzle 64, and suction fluid pipe 84 may be made from other suitable materials such as steel, copper, or brass.

Figure 6:
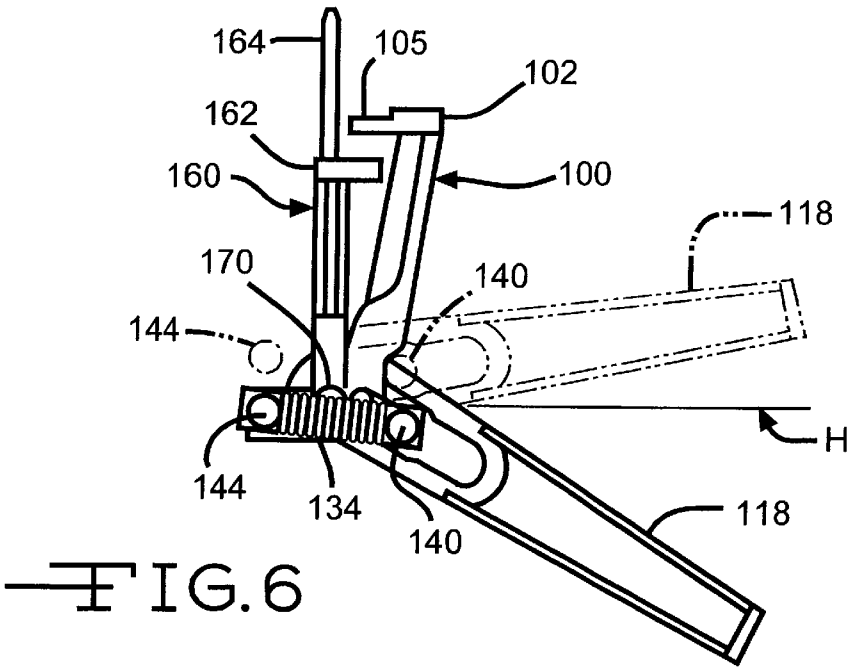
FIG. 6 is a side elevational view of the actuator assembly of FIG. 5.
Figure 9:
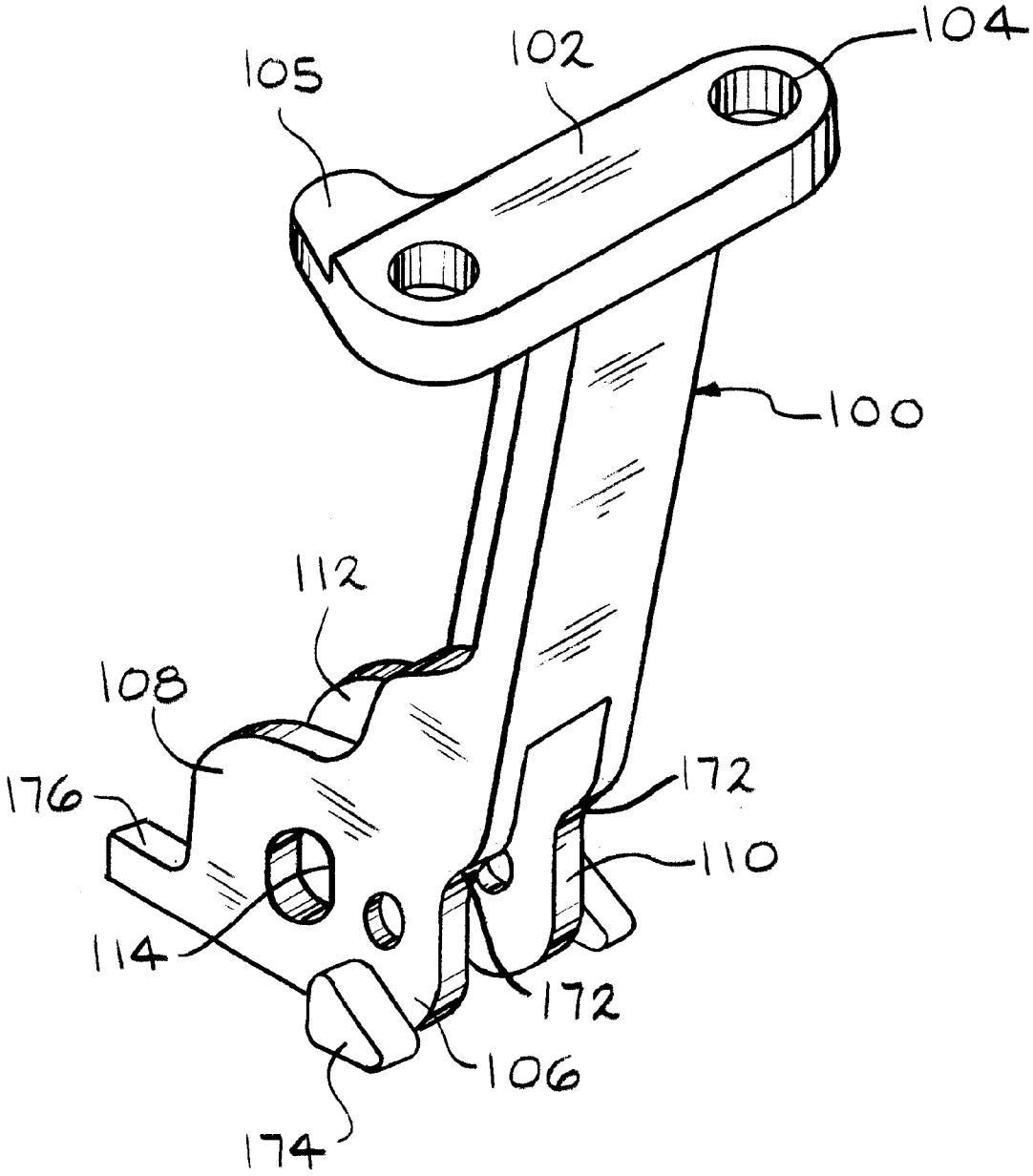
FIG. 9 is a perspective view of the mounting bracket of the actuator assembly illustrated in FIGS. 5 through 8.

Referring now to FIGS. 5 through 9, there is illustrated an actuator assembly 14 according to a preferred embodiment of the invention. Such an actuator assembly is commonly known as a spring assisted float mechanism or, more specifically, an over-center snap-action mechanism. The actuator assembly 14 includes a mounting bracket, shown generally at 100, for mounting the actuator assembly 14 to the pump 12. The upper portion of the mounting bracket 100 includes a mounting plate 102 with a pair of apertures 104 for mounting the actuator assembly 14 to the pressure vessel of the pump 12 using any suitable means, many of which are well known in the art. The mounting plate 102 also includes an outwardly extending portion 105. As best seen in FIG. 6, the outwardly extending portion 105 is slightly vertically lower in elevation than the mounting plate 102. As best seen in FIG. 9, the lower portion of the mounting bracket 100 includes a pair of substantially parallel, downwardly extending front arms 106, 110 and rear arms 108, 112, and a generally non-circular aperture therebetween having an inner surface 114. The purpose of the arms 106, 108, 110, 112 will be discussed below.

The actuator assembly 14 also includes a suction fluid detector, typically a float 116, shown in phantom in FIG. 5, that may be connected to a float arm 118 by inserting a threaded fastener (not shown) through an opening 120 located at the front of the float arm 118. Although the suction fluid detector shown in FIG. 5 is a float, other types of fluid detectors can be used, such as, for example, float switches, density based detectors, electrical resistance detectors, electrical capacitance detectors, pressure transducers, ultrasonic measuring devices, and optical measurement devices.

The actuator assembly 14 includes a mechanical linkage mechanism or spring assembly, shown generally at 122. The spring assembly 122 includes a pair of substantially cylindrical spring arms 124, 126. The spring arm 124 passes through an aperture 127 formed through the float arm 118 for engagement therewith. The spring arm 124 also includes a pair of outwardly extending arms 128. The arms 128 are substantially parallel and spaced a predetermined distance from each other. The spring arm 126 includes a pair of outwardly extending arms 130, and is substantially identical to the spring arm 124, except that the predetermined distance between the arms 130 is larger than the predetermined distance between the arms 128 such that the arms 130 lie outside the arms 128. However, it should be realized that the invention could be practiced by placing the arms 130 inside the arms 128. A pivot pin 132 passes through apertures on the arms 128, 130 to pivotally mount the spring arms 124, 126 about a pivot axis, A. The pivot pin 132 also passes through apertures on the arms 106, 110 of the mounting bracket 100 to pivotally mount the spring arms 124, 126 to the front of the mounting bracket 100 about the pivot axis, A. The pivot pin 132 further passes through an aperture in the rear of the float arm 118 to pivotally mount the float arm 118 about pivot axis, A.

The spring assembly 122 also includes a pair of coil springs 134, 136. One end of the spring 134 may be provided with an end cap 138 having a transverse internal bore extending therethrough having a diameter slightly larger than the diameter of a pivot pin 140 to pivotally mount the coil spring 134 about a pivot axis, B. Similarly, the other end of the spring 134 may be provided with an end cap 142 having a transverse internal bore therethrough having a diameter slightly larger than the diameter of a pivot pin 144 to pivotally mount the coil spring 134 about a pivot axis, C. Likewise, one end of the spring 136 may be provided with an end cap 146 having a transverse internal bore extending therethrough having a diameter slightly larger than the diameter of a pivot pin 148 to pivotally mount the coil spring 136 about the pivot axis, B. Similarly, the other end of the spring 136 may be provided with an end cap 150 having a transverse internal bore therethrough having a diameter slightly larger than the diameter of a pivot pin 152 to pivotally mount the coil spring 136 about the pivot axis, C. The distance, d, between the pivot axis, A, (for the pivot pin 132) and the pivot axis, B, (for the pivot pins 140, 148 for spring arm 124) is approximately 0.62 inches. The pivot pins 140, 144, 148, 152 may be attached to the spring arms 124, 126 by positioning cotter pins 154, 156 in apertures formed in the spring arms 124, 126, respectively.

The actuator assembly 14 includes an actuator, shown generally at 160. The upper portion of the actuator 160 includes a plate member 162. The plate member 162 of the actuator 160 also includes a push rod 164. The purpose of the push rod 164 will be described below. The lower portion of the actuator 160 is generally U-shaped including a pair of downwardly extending yoke arms 166, 168. A pivot pin 170 passing through an aperture in each yoke arm 166, 168, through apertures in the pair of arms 130, and through the U-shaped lower portion of the mounting bracket 100 pivotally mounts the actuator 160 about a pivot axis, D.

Figure 2:
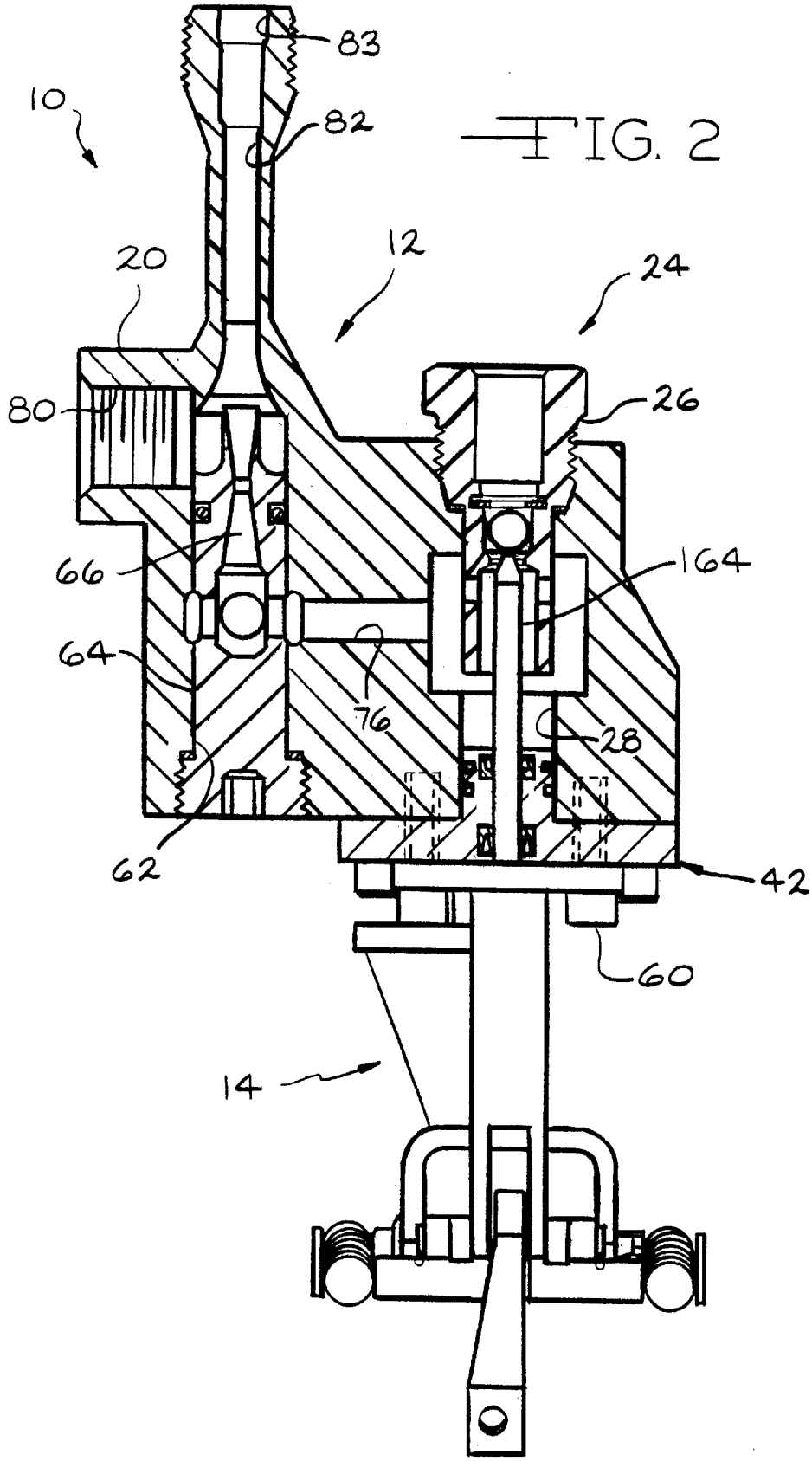
FIG. 2 is a front elevational view of the steam driven pump illustrated in FIG. 1 showing the pump assembly in cross section.
Figure 3:
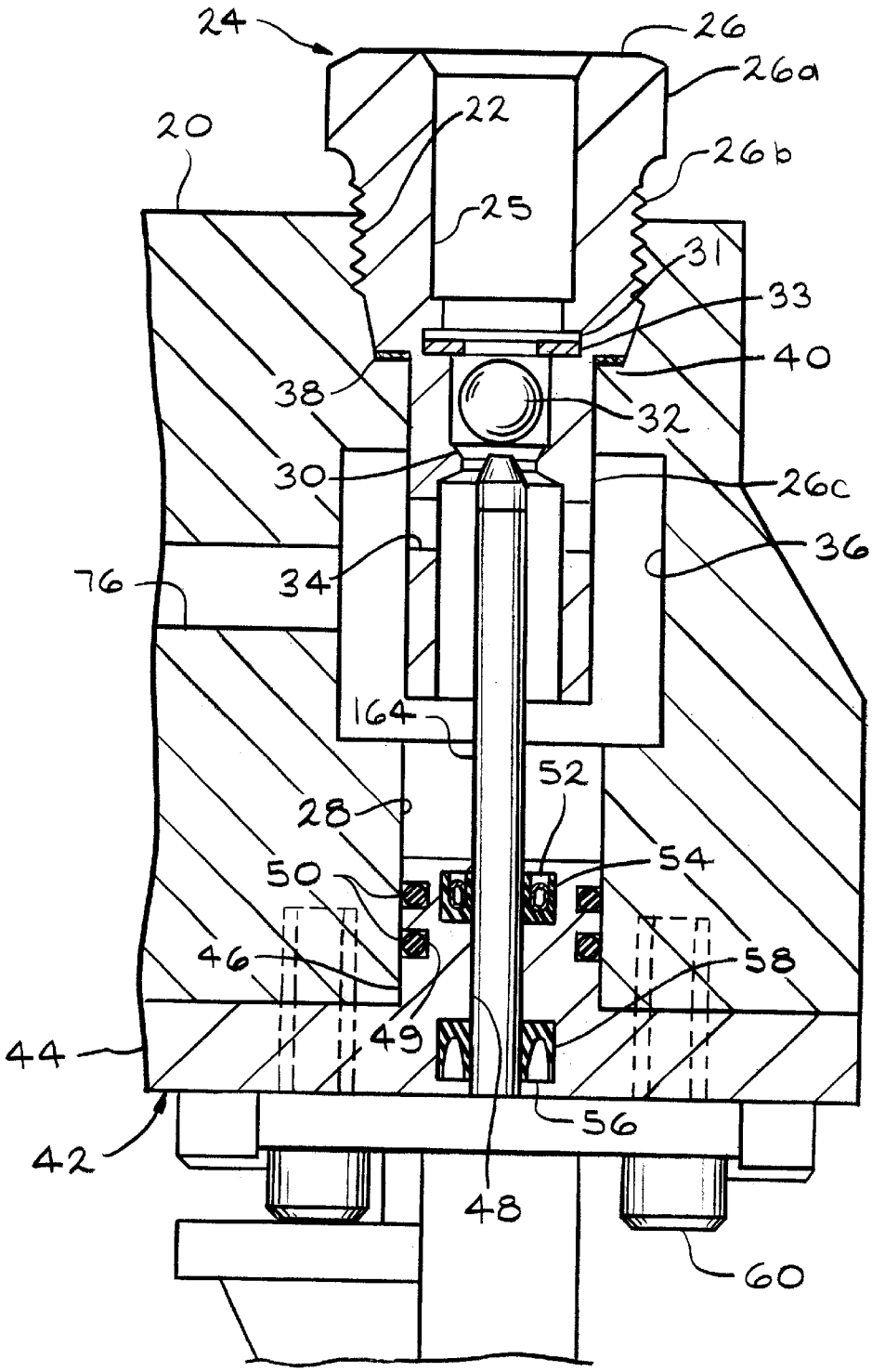
FIG. 3 is an enlarged cross-sectional view of the valve assembly and the mounting flange illustrated in FIG. 2.
Figure 4:
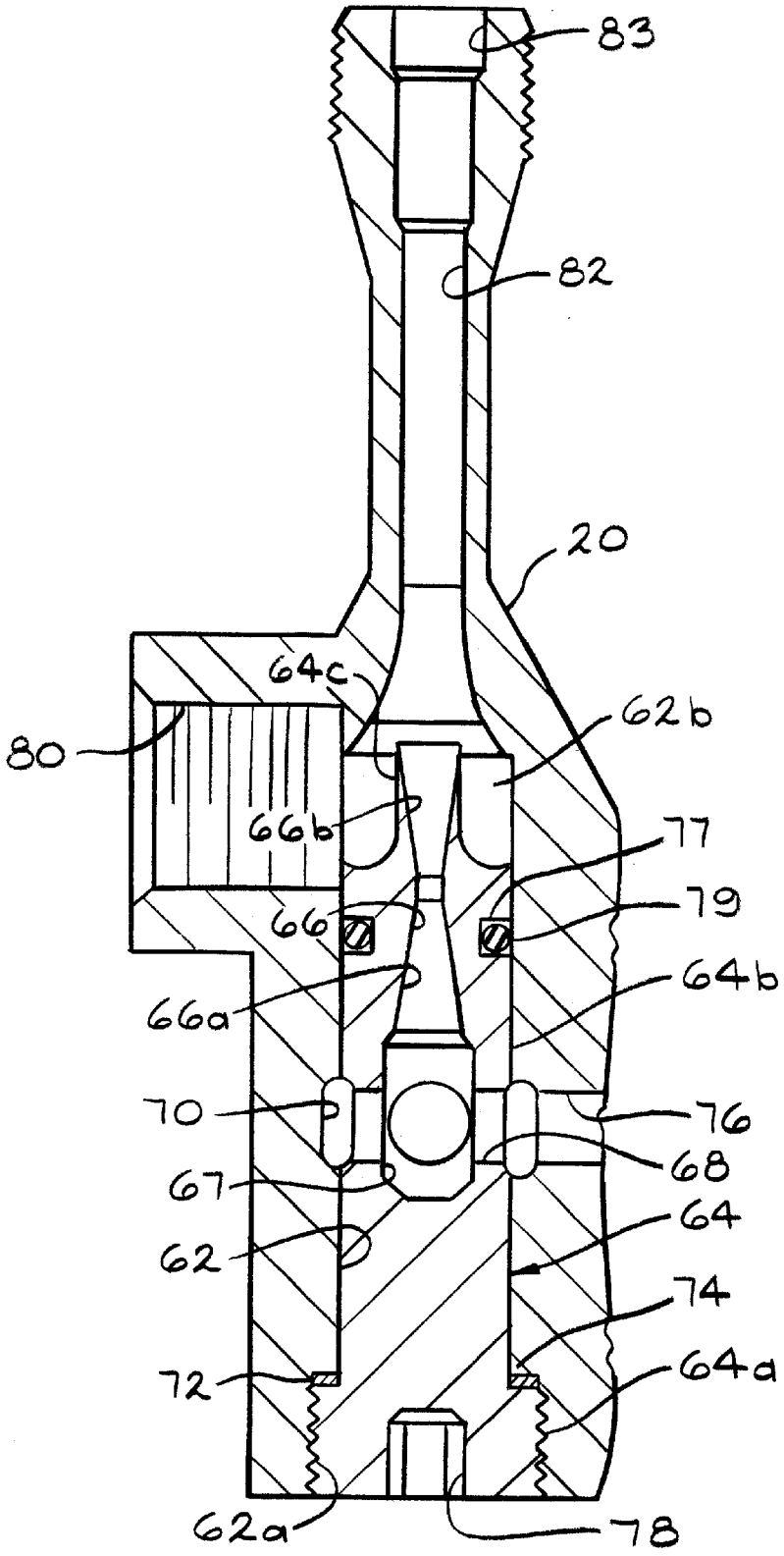
FIG. 4 is an enlarged cross-sectional view of the ejector nozzle, suction fluid inlet port, and outlet channel illustrated in FIG. 2.

As best seen in FIG. 2, the push rod 164 cooperates with the valve 32 of the motive fluid valve assembly 24. When the float 116 is at its lowest position, as shown in FIG. 2, the valve assembly 24 is closed. As the float 116 rises due to the liquid level rising in the container 81, the float 116 rotates about the pivot axis, A, and engages the spring arm 124. As the float 116 and float arm 118 continue to rise, the spring arm 124 also rises, increasing the tension of the coil springs 134, 136.

Referring now to FIG. 6, when the float 116 (with the float arm 118 attached thereto) reaches an upper tripping point, the energy stored in the coil springs 134, 136 causes both spring arms 124, 126 to snap upwards. The upper tripping point is defined as a line passing through pivot axes, A, B and C, when the pivot axis B, moves to a point that is approximately co-linear with the pivot axes A and C. Preferably, the upper tripping point has an upward angle (when viewing from left to right in FIG. 4) of approximately five degrees with respect to a horizontal axis H.

As best shown in FIG. 6, when the spring arms 124, 126 snap upwards over the upper tripping point, they move into oppositely upward oblique positions (shown in phantom in FIG. 4) such that arms 130 rotate about the pivot axis A, and arms 128 also rotate about the same pivot axis A. The rotation of the arms 130 causes the actuator 160 to simultaneously move upward. This upward movement of the actuator 160 causes the push rod 164, operatively coupled to the actuator 160, to move also simultaneously in the vertical direction. This movement causes the push rod 164 to-drive the valve 32 off the valve seat 30 to open the valve assembly 24.

It should also be realized that the distance d', between the pivot axis A, and the pivot axis D, may readily be varied to vary the amount of upward travel of the actuator 160 depending on the length of the stroke desired for the push rod 164. Also, it should be noted that in order for the springs 134, 136 of the actuator assembly 14 to exert a sufficient amount of force to maintain the valve assembly 24 in the open position, the pivot pin 170 should not engage an inner surface 114 of the mounting bracket 100 when the spring arms 124, 126 are in the up position.

As best seen in FIGS. 6 and 9, when the spring arms 124, 126 snap upwards over the upper tripping point, the spring arm 124 engages an angled surface 172 of the mounting bracket 100 to act as a stop, and thereby prevent excessive rotation of the spring arm 124. Preferably, the spring arm 124 has an upward angle of approximately thirty degrees and the spring arm 126 has an upward angle of approximately fifteen degrees with respect to the horizontal axis H, when they are in the up position.

As the liquid level in the container 81 decreases, the float 116 drops. Before the float 116 reaches its lowest position, the float arm 118 engages the spring arm 124. As the float 116 and float arm 118 continue to fall, the spring arm 124 also falls, increasing the tension of the coil springs 134, 136. When the float 116 reaches a lower tripping point, the energy stored in the coil springs 134, 136 causes both spring arms 124, 126 to snap downwards. Similar to the upper tripping point, the lower tripping point is defined as a line passing through pivot axes A, B and C, when the pivot axis B, moves to a point that is approximately co-linear with the pivot axes, A and C. During the downstroke of the spring arm 124, the lower tripping point has a downward angle (when viewing from left to right in FIG. 3) of approximately fifteen degrees with respect to the horizontal axis, H.

As best seen in FIGS. 6 and 9, when the spring arms 124, 126 snap downwards over the lower tripping point, the spring arm 124 engages an angled surface 174 of the mounting bracket 100 to act as a stop, and thereby prevent excessive rotation of the spring arm 124. In addition, the spring arm 126 engages an outer surface 176 of the mounting bracket 100 to act as a stop, and thereby prevent excessive rotation of the spring arm 126. Preferably, the spring arm 124 has a downward angle of approximately thirty-five degrees and the spring arm 126 has a downward angle of approximately five degrees with respect to the horizontal axis H, when they are in the down position.

In operation, movement of the float 116 past the upper tripping point causes upward movement of the push rod 164, thereby urging the valve 32 off the valve seat 30 to open the valve assembly 24. When the valve assembly 24 is opened, motive fluid, typically pressurized steam, travels through the axial passage 25, valve seat 30, radial channel 34, annular channel 36, fluid channel 76, annular channel 70, chamber 68, to the venturi 66 of the nozzle 64. When the pressurized steam enters the converging channel 66*a* of the venturi 66, the steam is constricted and its velocity increases. The increase in velocity causes a reduction in pressure, thereby causing the steam to entrain the suction fluid entering the housing 20 through the suction fluid pipe 84 and fluid inlet port 80. The combines steam and suction fluid then continues to flow out of the housing through the outlet channel 82.

After the fluid is drained out of the container 81, movement of the float 116 past the lower tripping point causes downward movement of the push rod 164, thereby allowing the valve 32 to contact the valve seat 30 and close the valve assembly 24.

An important aspect of the invention is the operation of the valve 32 in one of only two operable positions, including an opened position and a closed position. The actuator assembly 14 is directly mechanically linked to the valve 32 of the valve assembly 24 by means of the actuator 16 and push rod 164. The over-center snap-action actuator 14 only operates to move the push rod 164 upward when the float 116 reaches the upper tripping point, thereby driving the valve 32 off the valve seat 30 and moving the valve 32 to its opened position. The operation of the snap-action actuator 14 ensures that the push rod 164 moves upward until the spring arm 124 engages the angled surface 172 of the mounting bracket 100, and that the valve 32 has no intermediate open positions such as occur in a conventional modulating float-operated valve.

The rod 164 remains in such an opened position, and the valve 32 therefore remains off the valve seat 30 until the float 116 moves past the lower tripping point. Movement of the float 116 past the lower tripping point moves the push rod 164 downward past the valve seat 30, allowing the valve 32 to sealingly contact the valve seat 30, and thereby moving the valve 32 to its closed position. As with upward movement of the push rod 164, the operation of the snap-action actuator 14 ensures that the push rod 164 moves downward until the spring arm 124 engages the angled surface 174, and spring arm 126 engages the outer surface 176 of the mounting bracket 100. The valve 32 therefore has no intermediate open positions during the downward movement of the push rod 164, such as occur in a conventional modulating float-operated valve. Although the actuator assembly illustrated is an over-center snap-action mechanism, other types of actuation methods may be used, such as, for example, solenoid and magnetic actuation, direct and piloted pneumatic actuation, and linear screw actuation.

Thus the novel combination of the over-center snap-action actuator 14 mechanically linked to the ball check valve assembly 24 allows the valve assembly 24 to operate in only an open position and a closed position. Such a pump assembly eliminates at least the problems of complex valve design, excessive valve wear caused by steam bleeding past the valve and valve seat in a partially open valve arrangement, and fouling of the valve and actuator associated with conventional piloted steam valves.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A pump comprising:

a housing having at least one fluid channel;

a motive fluid inlet port;

a suction fluid inlet port;

a discharge port;

a venturi disposed in the at least one fluid channel of said housing, and connected by way of the at least one fluid channel to said motive fluid inlet port, said suction fluid inlet port, and said discharge port;

a ball check valve operatively disposed between said motive fluid inlet port and said venturi for controlling the flow of motive fluid, wherein said ball check valve has only two operable positions including an opened position and a closed position; and an actuator assembly for actuating said ball check valve.

2. The pump according to claim 1 wherein said actuator assembly includes a spring assisted float mechanism.

3. The pump according to claim 2 wherein said spring assisted float mechanism is an over-center snap-action mechanism.

4. The pump according to claim 1 wherein said actuator assembly includes an actuator having a first position and a second position;

wherein when said actuator assembly is in the first position, said ball check valve is moved into its open position by a mechanical linkage; and wherein when said actuator assembly is in the second position, said ball check valve is moved into its closed position by the mechanical linkage.

5. The pump according to claim 1 wherein said actuator assembly includes a push rod for actuating a valve of said ball check valve.

6. A pump comprising:

a housing having at least one fluid channel therein;

a motive fluid inlet port;

a suction fluid inlet port;

a discharge port;

a venturi disposed in the at least one fluid channel of said housing, and connected by way of the at least one fluid channel to said motive fluid inlet port, said suction fluid inlet port, and said discharge port;

a valve operatively disposed between said motive fluid inlet port and said venturi for controlling the flow of motive fluid, said valve being operable in only two positions including an opened position and a closed position;

a suction fluid detector for detecting a level of suction fluid; and an actuator assembly for actuating said valve, said actuator assembly being directly connected to said valve by means of a mechanical linkage, and connected to said suction fluid detector for actuation in response to a detected level of suction fluid.

7. The pump according to claim 6 wherein said valve is a ball check valve.

8. The pump according to claim 6 wherein said suction fluid detector is directly connected to said actuator assembly by means of a mechanical linkage.

9. The pump according to claim 6 wherein said actuator assembly includes an actuator having a first position and a second position;

wherein when the actuator assembly is in the first position, said valve is moved into its open position by a mechanical linkage; and wherein when the actuator assembly is in the second position, said valve is moved into its closed position by the mechanical linkage.

10. The pump according to claim 6 wherein said actuator assembly includes a push rod for actuating said valve.

11. A pump comprising:

a housing having at least one fluid channel therein;

a motive fluid inlet port;

a suction fluid inlet port;

a discharge port;

a container for containing suction fluid;

a venturi disposed in the at least one fluid channel of said housing, and connected by way of the at least one fluid channel to said motive fluid inlet port, said suction fluid inlet port, and said discharge port;

a valve operatively disposed between said motive fluid inlet port and said venturi for controlling the flow of motive fluid, said valve being operable in only two positions including an opened position and a closed position;

a suction fluid detector for detecting a level of suction fluid in said container; and an actuator assembly for actuating said valve, said actuator assembly being directly connected to said valve by means of a mechanical linkage, and connected to said suction fluid detector for actuation in response to a detected level of suction fluid.

12. The pump according to claim 11 wherein said valve is a ball check valve.

13. The pump according to claim 11 wherein said suction fluid detector is connected to said valve by means a mechanical linkage.

14. The pump according to claim 13 wherein said suction fluid detector is a float.

15. The pump according to claim 11 wherein said actuator assembly includes a spring assisted float mechanism.

16. The pump according to claim 15 wherein said spring assisted float mechanism is an over-center snap-action mechanism.

17. The pump according to claim 11 wherein said actuator assembly includes a push rod for actuating said valve.

18. The pump according to claim 11 wherein said actuator assembly includes an actuator having a first position and a second position;

wherein when the actuator assembly is in the first position, said valve is moved into its open position by a mechanical linkage; and wherein when the actuator assembly is in the second position, said valve is moved into its closed position by the mechanical linkage.

19. The pump according to claim 18 including:

a ball check valve;

a float connected to said ball check valve by means of a mechanical linkage; and an over-center snap-action mechanism having a push rod for actuating said ball check valve.

* * * * *